US012448185B1

(12) United States Patent
Box et al.

(10) Patent No.: US 12,448,185 B1
(45) Date of Patent: Oct. 21, 2025

(54) PLASTIC METER LID AND FRAME ASSEMBLY FOR AN IN-GROUND METER BOX

(71) Applicant: SIGMA CORPORATION, Cream Ridge, NJ (US)

(72) Inventors: Stuart J. Box, Cropwell, AL (US); Steven D. Kreiser, Wrightstown, NJ (US)

(73) Assignee: SIGMA CORPORATION, Cream Ridge, NJ (US)

( * ) Notice: Subject to any disclaimer, the term of this patent is extended or adjusted under 35 U.S.C. 154(b) by 245 days.

(21) Appl. No.: 18/232,121

(22) Filed: Aug. 9, 2023

Related U.S. Application Data

(60) Provisional application No. 63/403,011, filed on Sep. 1, 2022.

(51) Int. Cl.
*B65D 51/18* (2006.01)
*B65D 43/02* (2006.01)

(52) U.S. Cl.
CPC ..... *B65D 51/18* (2013.01); *B65D 43/0202* (2013.01); *B65D 2203/10* (2013.01); *B65D 2543/00194* (2013.01); *B65D 2543/00277* (2013.01); *B65D 2543/00296* (2013.01); *B65D 2543/00314* (2013.01); *B65D 2543/00398* (2013.01); *B65D 2543/00509* (2013.01)

(58) Field of Classification Search
CPC ..... B65D 2543/00398
USPC ..... 52/20; 404/25; 220/484
See application file for complete search history.

(56) References Cited

U.S. PATENT DOCUMENTS

| | | | |
|---|---|---|---|
| 2,217,097 | A | 10/1940 | Brooks |
| 3,952,908 | A | 4/1976 | Carson |
| 4,611,713 | A | 9/1986 | Byrns |
| 5,123,776 | A | 6/1992 | Lang et al. |
| 5,511,345 | A | 4/1996 | Jones et al. |
| 6,177,883 | B1 | 1/2001 | Jennetti et al. |
| 6,273,938 | B1 | 8/2001 | Fanselow et al. |
| 6,968,969 | B1 | 11/2005 | McKinnon, Jr. |
| 7,353,966 | B2 | 4/2008 | McKinnon, Jr. |
| 7,361,834 | B1 | 4/2008 | Transgrud et al. |
| 7,500,578 | B1 | 3/2009 | McKinnon, Jr. |
| 9,435,099 | B2 | 9/2016 | Dang |
| 10,240,316 | B2 | 3/2019 | Dang |
| 11,066,803 | B2 | 7/2021 | Dang |
| 2006/0254327 | A1 | 11/2006 | Stachowiak, Jr. |
| 2007/0054406 | A1 | 3/2007 | Frederickson |

(Continued)

*Primary Examiner* — Anthony D Stashick
*Assistant Examiner* — L Kmet
(74) *Attorney, Agent, or Firm* — Caesar Rivise, PC

(57) ABSTRACT

A lid assembly for an in-ground meter box that can withstand substantial loads (e.g., 22, 500 lbs) without deformation. The lid assembly includes a metal frame secured to the bottom side of a plastic lid to allow the plastic lid to seat tightly for covering the in-ground meter box. The metal frame provides the rigidity and strength to withstand the loading while simultaneously providing the lid with sufficient weight to make it non-bouyant, i.e., should the surrounding ground environment become flooded, the lid is heavy enough to remain in place, covering the meter box and will not float away. The metal frame also is detectable by a metal detector should the lid every be covered over with debris and need to be located. The plastic lid body (e.g., linear low-density polyethylene (LLDPE)) of the lid assembly avoids radio signal interference or attenuation emanating from a transmitter positioned within the meter box.

18 Claims, 16 Drawing Sheets

(56) References Cited

U.S. PATENT DOCUMENTS

| | | | |
|---|---|---|---|
| 2007/0152829 | A1 | 7/2007 | Lindsay et al. |
| 2007/0205012 | A1 | 9/2007 | Stachowiak, Jr. |
| 2009/0044869 | A1 | 2/2009 | Brown et al. |
| 2009/0154072 | A1 | 6/2009 | Stachowiak, Jr. |
| 2011/0255215 | A1 | 10/2011 | Todd, II et al. |
| 2012/0042485 | A1 | 2/2012 | Evans et al. |
| 2014/0063696 | A1 | 3/2014 | Todd, II et al. |
| 2014/0268506 | A1 | 9/2014 | Emanuel |
| 2018/0305887 | A1 | 10/2018 | Savino |
| 2020/0385951 | A1 | 12/2020 | Box et al. |

PLASTIC METER LID AND FRAME ASSEMBLY FOR AN IN-GROUND METER BOX

CROSS-REFERENCE TO RELATED APPLICATIONS

This non-provisional application claims the benefit under 35 U.S.C. § 119 (e) of Application Ser. No. 63/403,011 filed on Sep. 1, 2022 entitled PLASTIC METER LID AND FRAME ASSEMBLY FOR AN IN-GROUND METER BOX, and whose entire disclosure is incorporated by reference herein.

BACKGROUND OF THE INVENTION

The present invention relates generally to meter box lids and, more particularly, to a plastic meter box lid which couples to a frame to form a lid assembly that acts as a closure to an in-ground meter box and which can withstand substantial loads applied thereto.

The general understanding in today's market is that a meter box and lid combination should be able to support a vertical load of at least 16,000 lbs. for vehicles, bicycles, people, etc., traveling over the lid. The simple solution for that is to supply a standard ductile iron lid and the vertical load is easy to achieve. However, with the rapid deployment of remote sensing (viz., meter reading) technology, it is widely accepted that ductile iron lids do not allow for good transmission from the sending unit in the meter to the remote collection and storage locations for the data. As such, plastic is the preferred material for lids. Examples of such plastic lids are provided in the following U.S. Pat. Nos. 3,952,908 (Carson); 5,123,776 (Lang); 6,968,969 (McKinnon, Jr.); 7,353,966 (McKinnon, Jr.); 7,500,578 (Mckinnon, Jr.). See also U.S. Patent Publication No. 2020/0385951 (Box, et al.), which is assigned to the same assignee as the present application, namely, Sigma Corporation of Cream Ridge, NJ, and whose entire disclosure is incorporated by reference herein in its entirety.

However, although plastic lids have better properties for transmission of data, they fall short in several aspects, namely, (1) plastic is buoyant and will float on water if the meter box is flooded; (2) many times the lid gets buried or is inadvertently covered over and needs to be located; one method of detecting a hidden ductile iron lid is to use a metal detector; but this detection method is rendered useless if the covered lid comprises plastic since plastic is not detectable with a metal detector; and (3) plastic in rotomolding is hollow and does not have enough strength to support even 5000 lbs.

So while the devices of the aforementioned patents are suitable for their intended purposes, they nevertheless leave something to be desired as discussed above. Thus, a need exists for a plastic meter box lid cover which overcomes the drawbacks of the prior art. The subject invention addresses that need.

All references cited herein are incorporated herein by reference in their entireties.

BRIEF SUMMARY OF THE INVENTION

A lid assembly configured for being positioned on top of an in-ground meter box to form a cover of the in-ground box is disclosed. The lid assembly comprising: a plastic member (e.g., linear low-density polyethylene (LLDPE)) forming the lid; a metal frame (e.g., steel) having a pair of elongated rails coupled together by a pair of transverse ribs; and wherein the metal frame is attached to a bottom side of the lid wherein said elongated rails form opposing sides of the lid assembly and the transverse ribs are positioned within a bottom side of the plastic member.

A method of forming a lid assembly configured for covering an in-ground meter box to form a cover to the in-ground box is disclosed. The method comprises: forming a plastic lid (e.g., linear low-density polyethylene (LLDPE)) having bottom side with recesses running parallel on two opposite sides of the lid and with a pair of narrow slits running perpendicular to the recesses in between said pair of recesses; forming a metal frame (e.g., steel) having a pair of elongated rails coupled together by a pair of transverse ribs, the transverse ribs being spaced apart from each other to align with the pair of narrow slits; and inserting an upper edge of the pair of transverse ribs into respective slits to attach the metal frame to the plastic lid and the pair of elongated rails are seated within respective recesses in said plastic lid.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENTS

Figure 1:
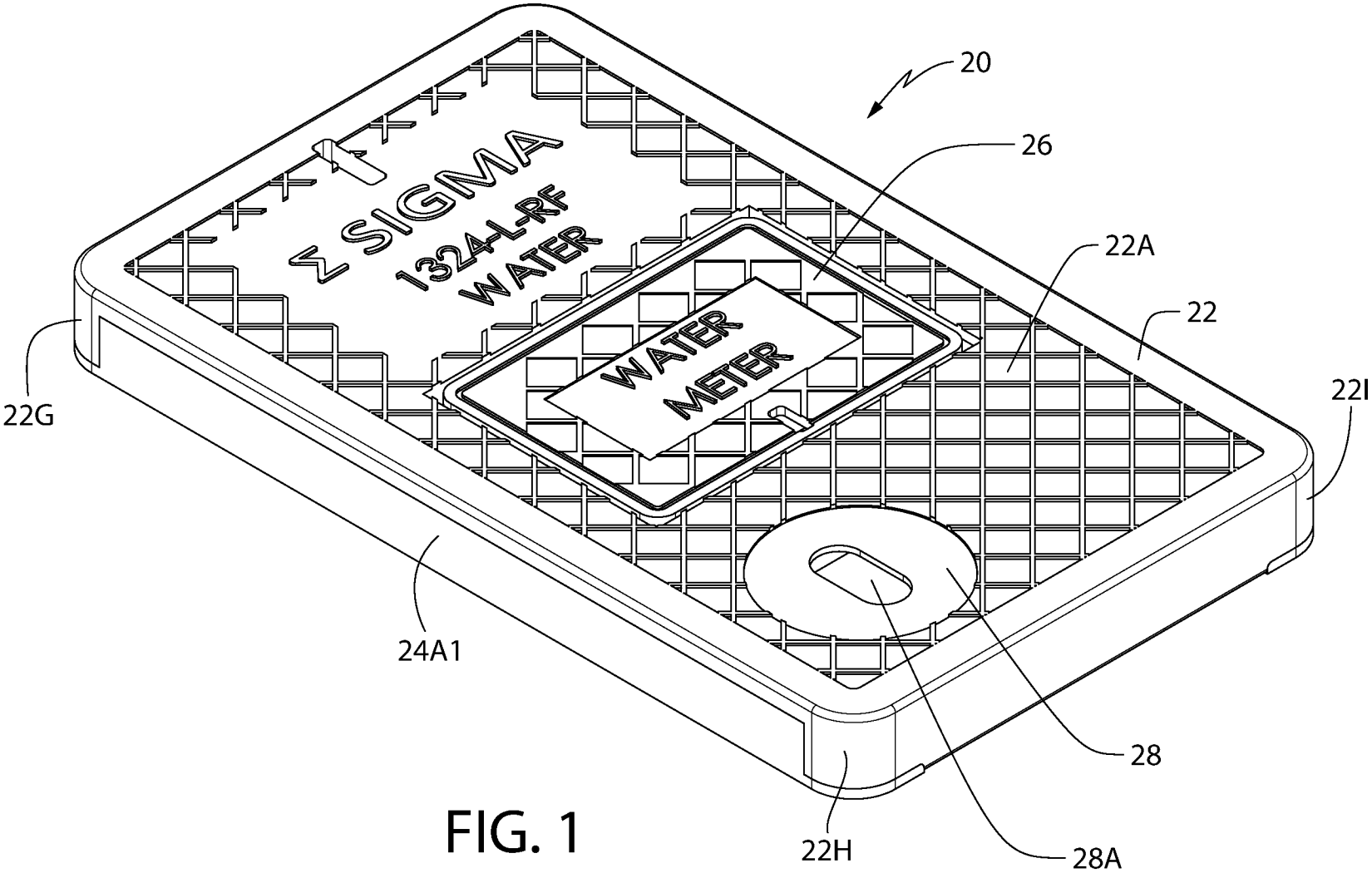
FIG. 1 is a top left isometric view of the plastic lid/metal frame assembly of the present invention and shown with a door (also referred to as a "flip reader") closed.

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

FIGS. 1-5 show the present invention 20 which comprises a plastic lid body 22 to which a metal frame 24 (FIGS. 6-9) is secured to form a plastic lid/metal frame assembly 20 which is then positioned on top of an in-ground meter box 10 (see FIG. 10) to form the cover of the in-ground meter box 10.

Figure 15:
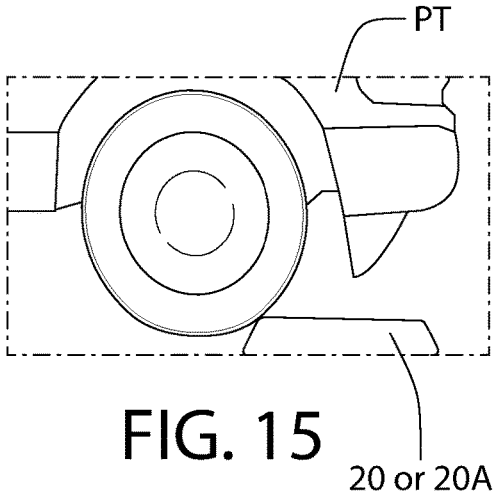
FIG. 15 depicts a pick-up truck riding over the plastic lid/metal frame assembly of the present invention when installed on an in-ground meter box with no damage to the present invention.
Figure 16:
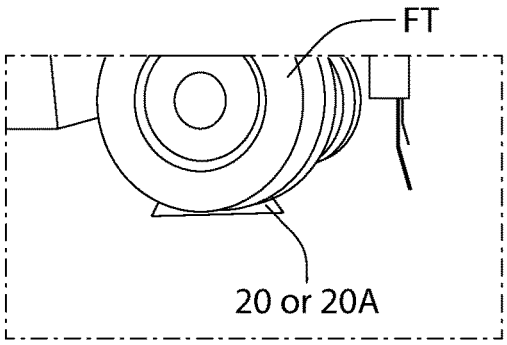
FIG. 16 depicts a flatbed truck riding over the plastic lid/metal frame assembly of the present invention when installed on an in-ground meter box with no damage to the present invention.

The metal (e.g., steel) frame 24 provides the rigidity and strength to the plastic lid body 22 to withstand the heavy loads (e.g., vehicles driving over the lid; see FIGS. 15-16). In particular, the plastic material used to form the lid body 22 is linear low-density polyethylene (LLDPE).

The four key features of the plastic lid/metal frame assembly 20 (hereinafter "lid assembly") of the present invention are:

1) The lid assembly 20 supports the loads applied thereto; e.g., vehicles driven over, or parked on, the lid;
2) The lid assembly 20 provides sufficient weight so that it is non-floating, i.e., should the surrounding ground environment become flooded, the lid assembly 20 is heavy enough to remain in place, covering the meter box 10 and will not float away; thus, the lid assembly 20 is non-buoyant;
3) The lid assembly 20, via the metal frame, is detectable by a metal detector despite the lid body comprising plastic; and
4) The lid assembly 20 does not interfere with or attenuate any radio signals emanating from a transmitter positioned within the meter box 10.

Figure 1A:
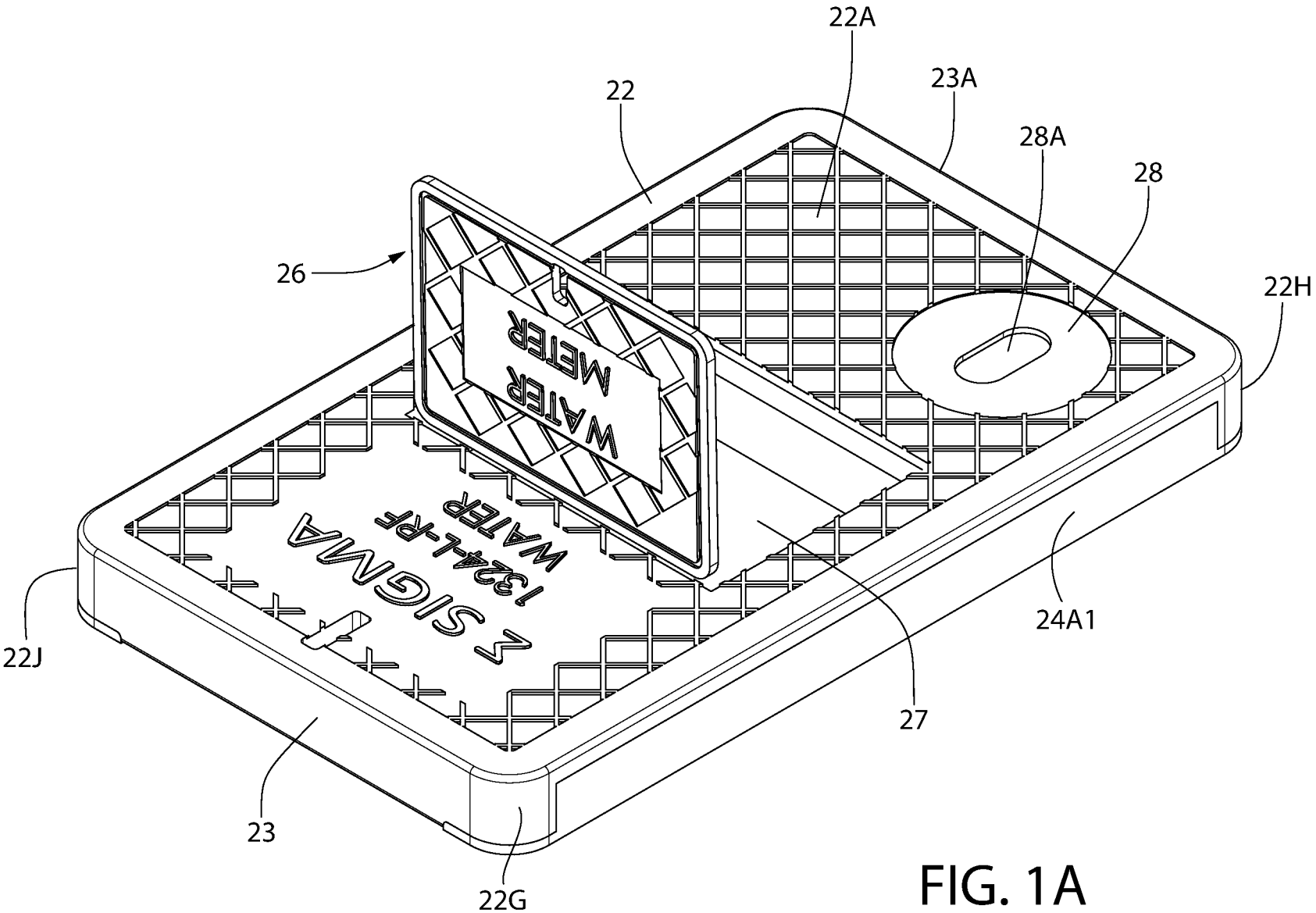
FIG. 1A is to right isometric view of the plastic lid/metal frame assembly of the present invention and shown with the door opened.
Figure 1B:
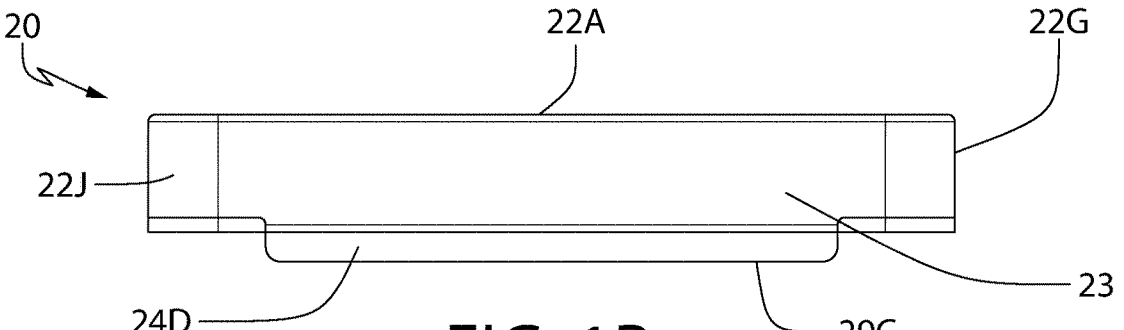
FIG. 1B is front view of the present invention with respect to FIG. 1.
Figure 1C:
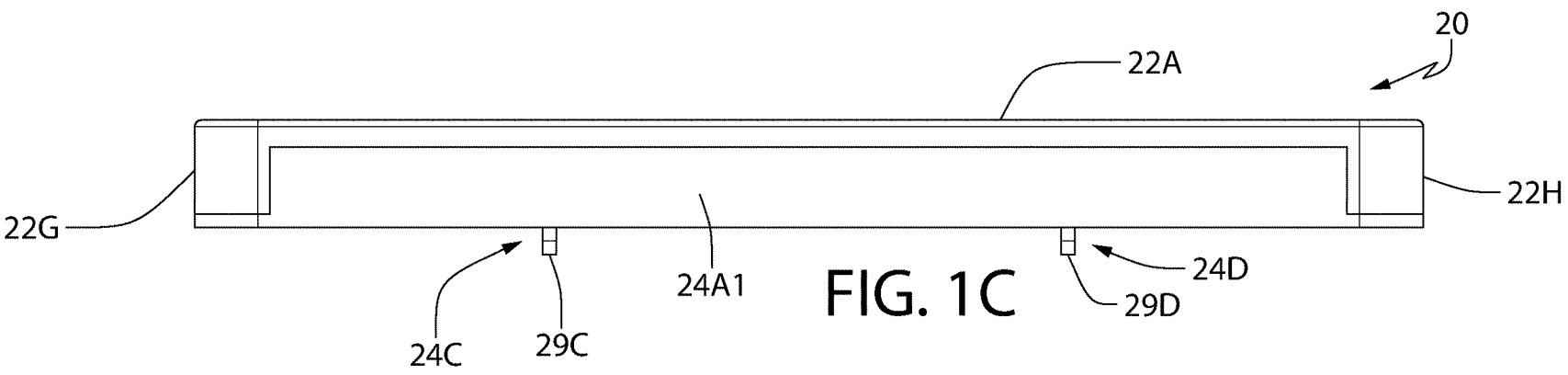
FIG. 1C is a side of view of the present invention.
Figure 1D:
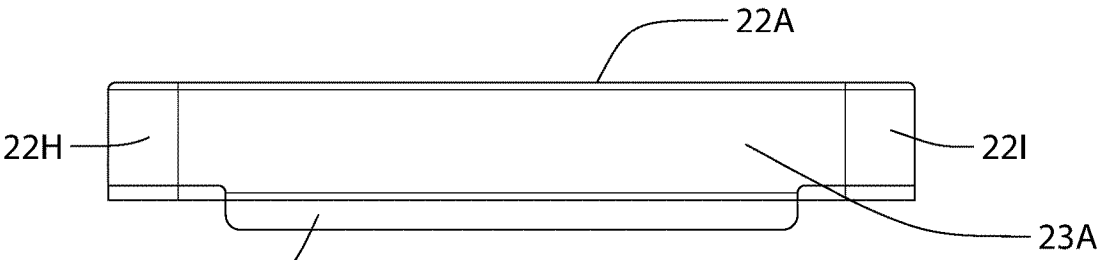
FIG. 1D is a back view of the present invention with respect to FIG. 1.
Figure 2:
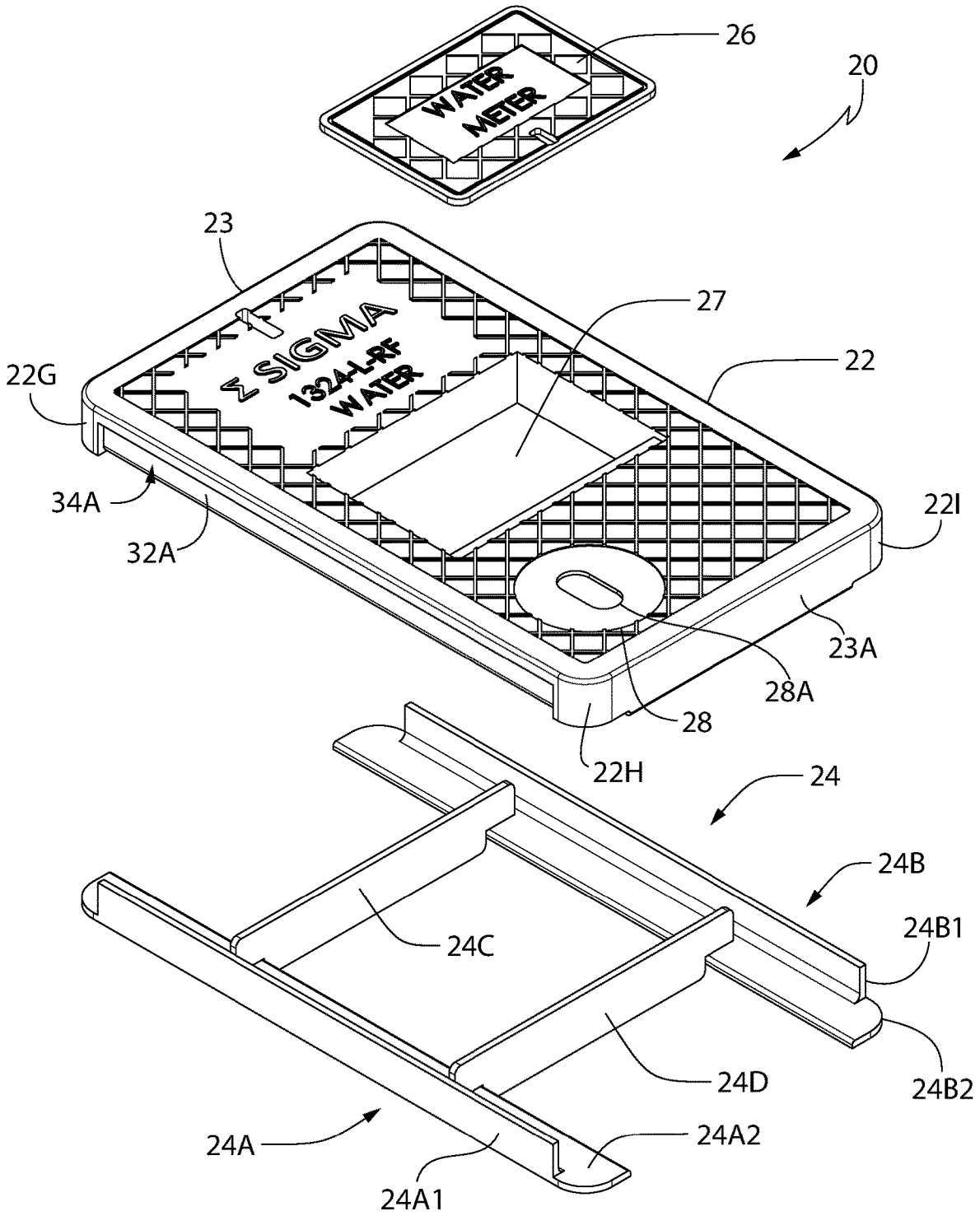
FIG. 2 is an exploded isometric view of the plastic lid/metal frame assembly of the present invention shown.
Figure 3:
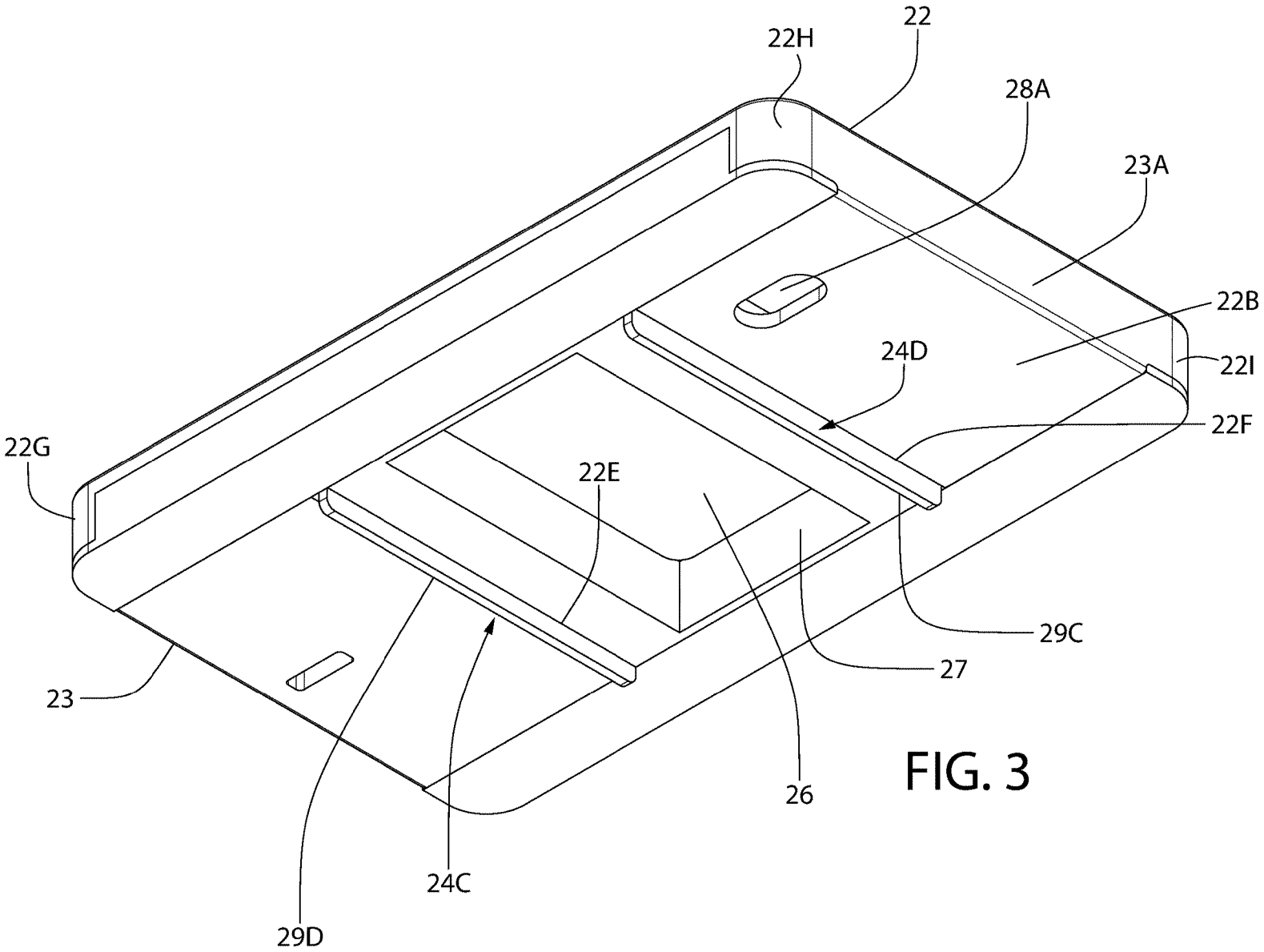
FIG. 3 is a bottom isometric view of the plastic lid/metal frame assembly of the present invention.
Figure 3A:
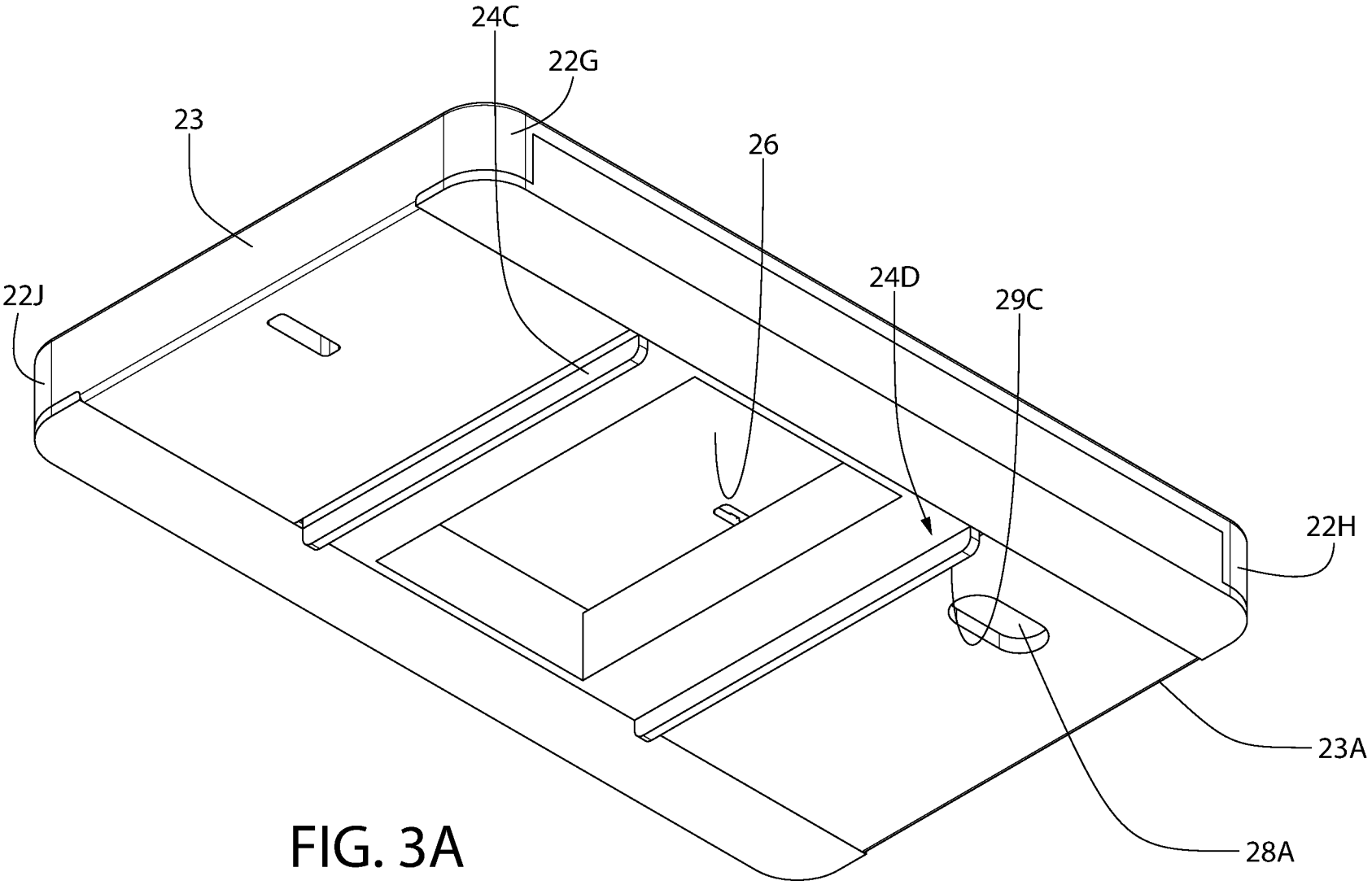
FIG. 3A is an alternative bottom isometric view of the plastic lid/metal frame assembly of the present invention.
Figure 4:
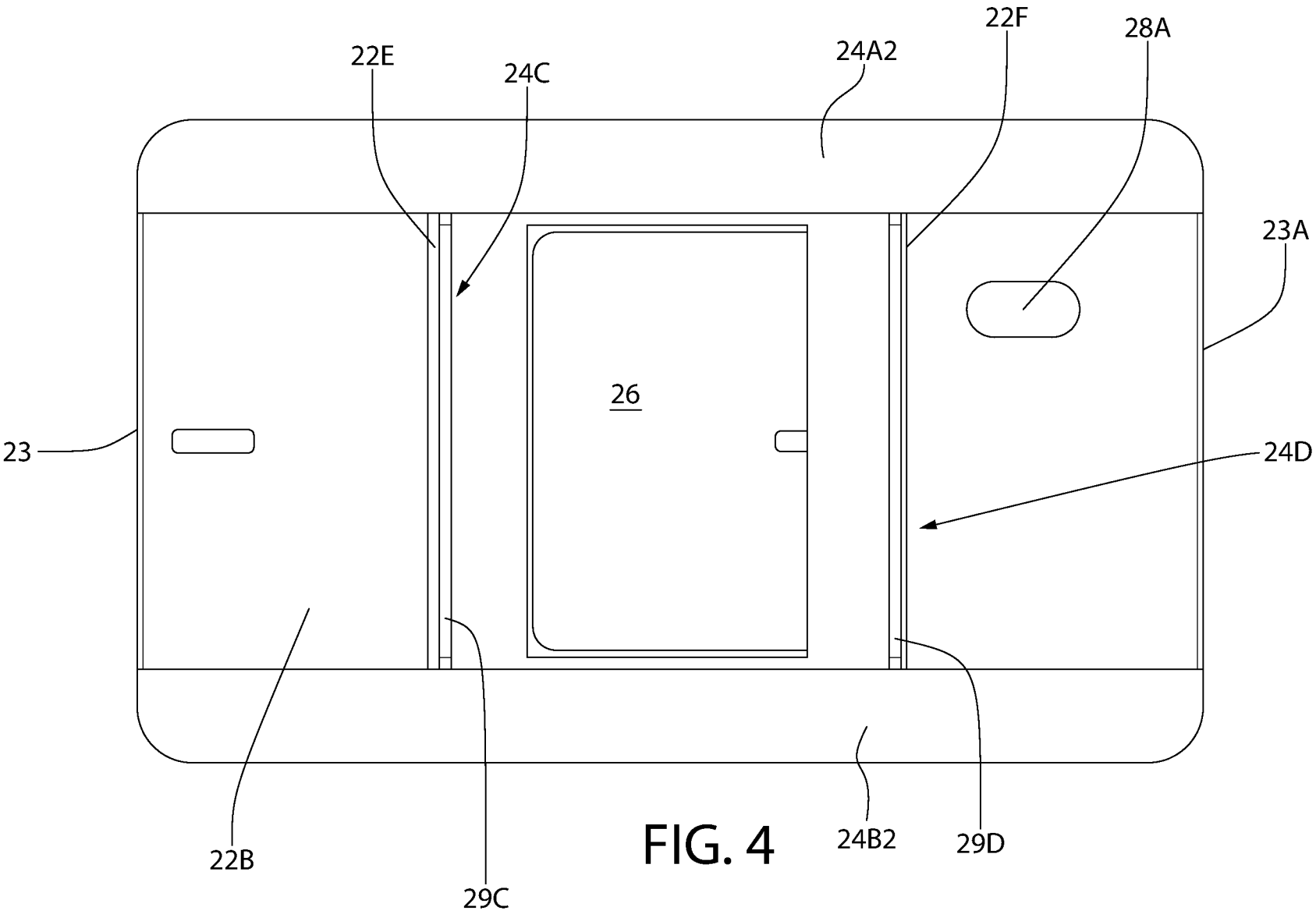
FIG. 4 is a bottom plan view of the plastic lid/metal frame assembly of the present invention.
Figure 5:
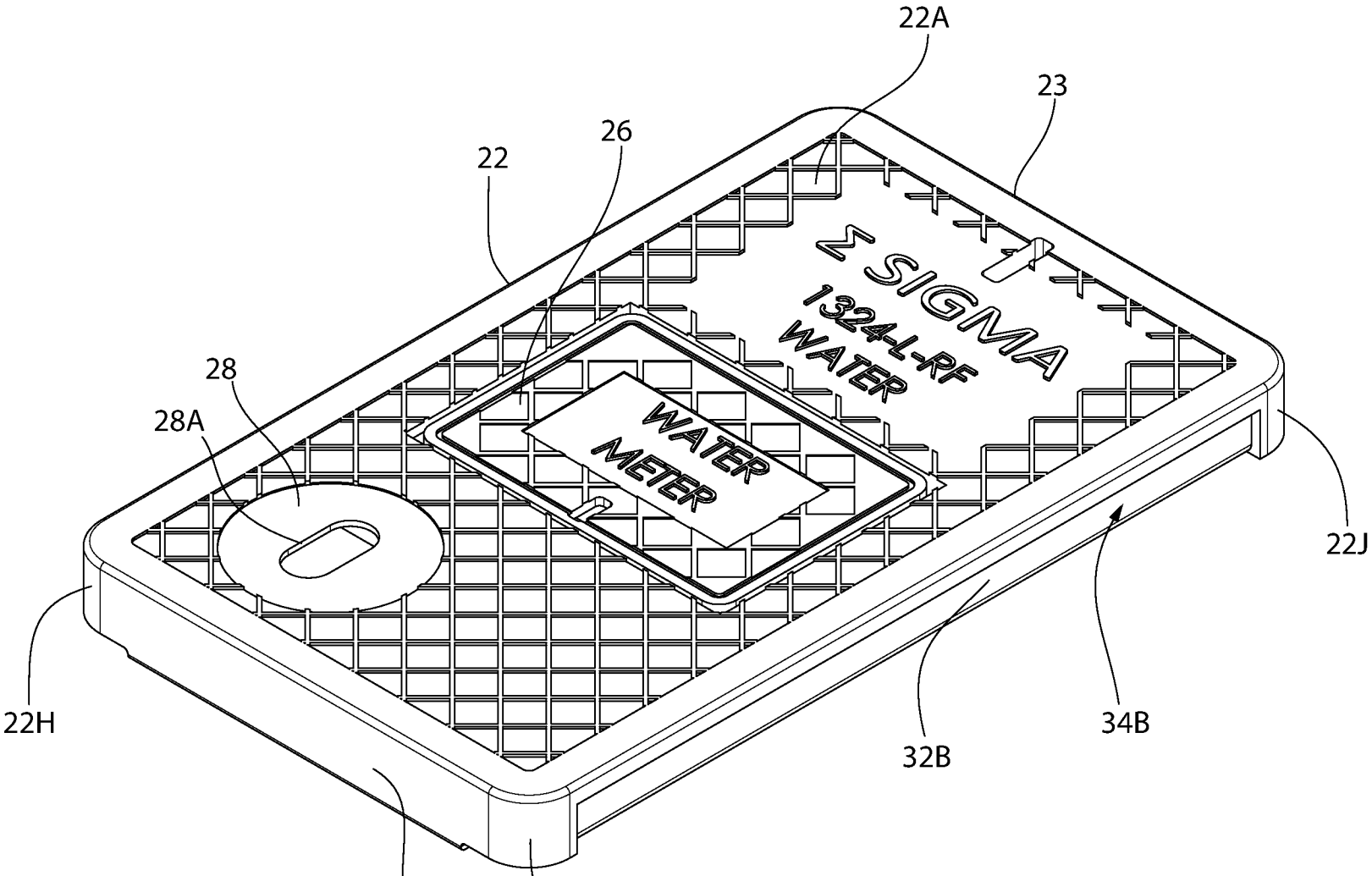
FIG. 5 is an isometric view of the plastic lid similar to the view of FIG. 2 but taken on the opposite side of the lid body to show the recess on that opposite side.

As shown in FIGS. 1-4, the top side 22A of the plastic lid body 22 comprises a door 26 (also known as a "flip reader") that is removable from an opening 27 (FIG. 1A) that permits a technician to gain access to the interior of the in-ground meter box 10 (see FIG. 10) without having to remove the entire lid assembly 20. The top side 22A also comprises a countersunk portion 28 having an aperture 28A for receiving a wireless transponder device (not shown); through this aperture 28A, as shown in FIG. 3 on the bottom side 22B of the plastic lid body 22 permits electrical connections to be made with the equipment in the meter box 10 and the transponder device. The plastic lid body 22 has a first end 23 and a second end 23A.

FIGS. 6-9 depict the frame assembly 24 that comprises a pair of elongated rails 24A and 24B, each having a cross-sectional "L-shape" (see FIG. 8) that are connected together by transverse ribs 24C and 24D. The height dimension 25 (FIGS. 6 and 8, e.g., 11/2 inches) of those ribs 24C/24D provides one of the key strength aspects of the lid assembly 20 to withstand the loads applied thereto. The respective upper edges 29A and 29B of those transverse ribs 24A/24B are pressed into the plastic lid body 22 and the bottom edges 29C and 29D protrude from narrow transverse (perpendicular to the opposing long sides of the plastic lid body 22) slits 22E and 22F, respectively, (FIGS. 3, 12 and 14) on the bottom side 22B of the plastic lid body 22. Although an adhesive (e.g., glue, etc.) could first be applied into the slits 22E/22F, it is the interference/friction fit of the upper edges 29A/29B into the slits 22E/22F that is sufficient to secure the frame 24 within the plastic lid body 22.

Figure 6:
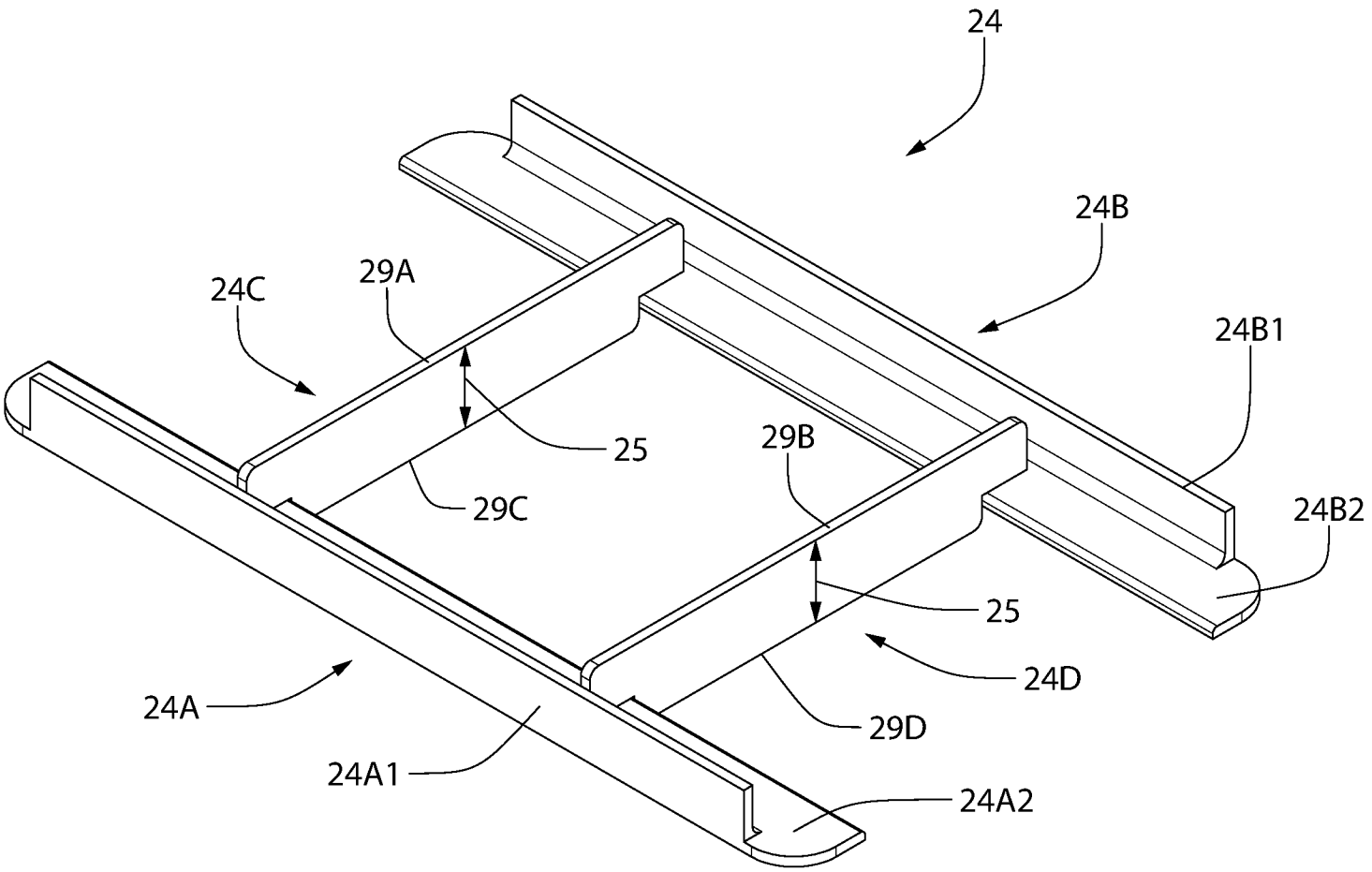
FIG. 6 is a top isometric view of the metal frame of the present invention.
Figure 7:
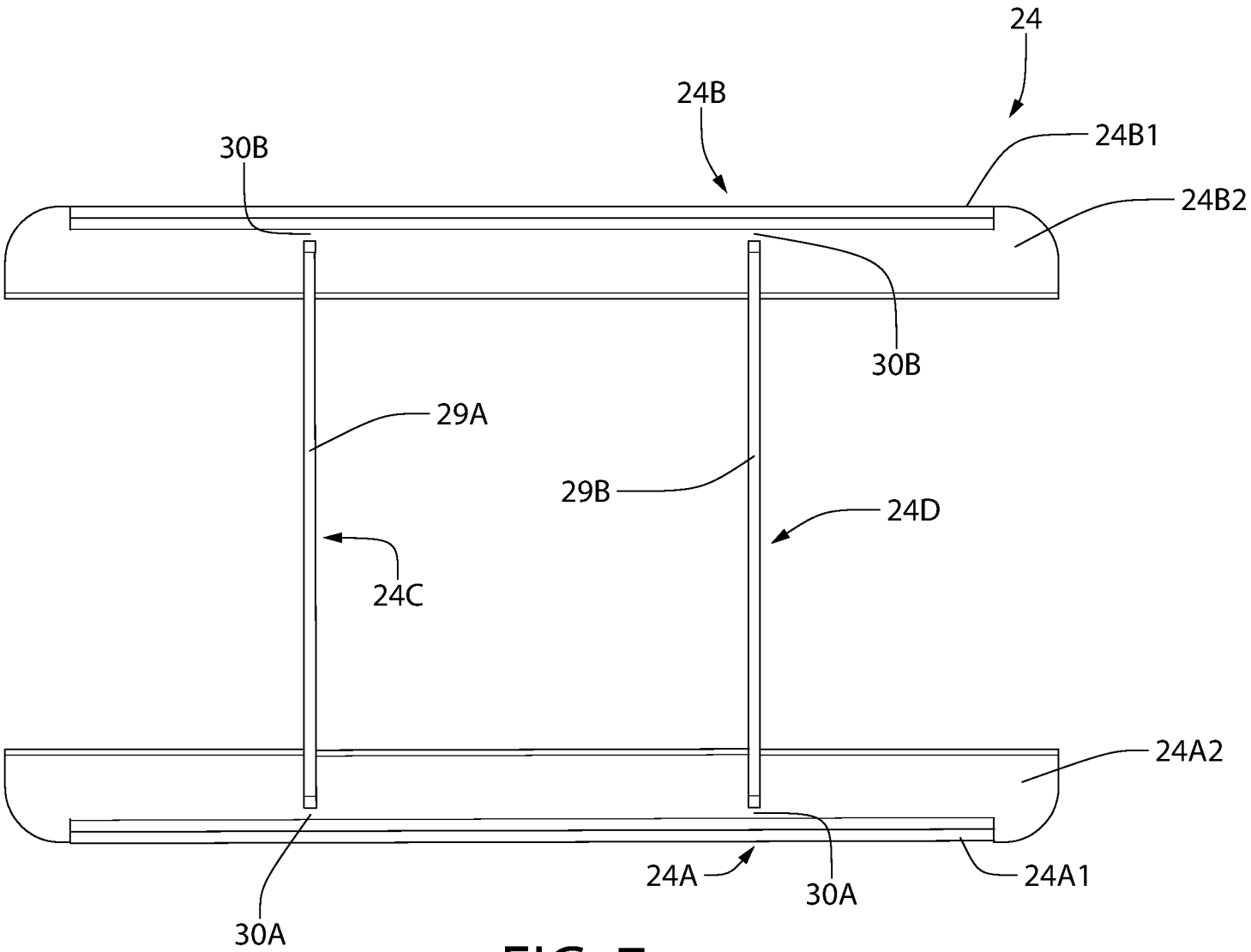
FIG. 7 is a top plan view of the metal frame of the present invention.
Figure 8:
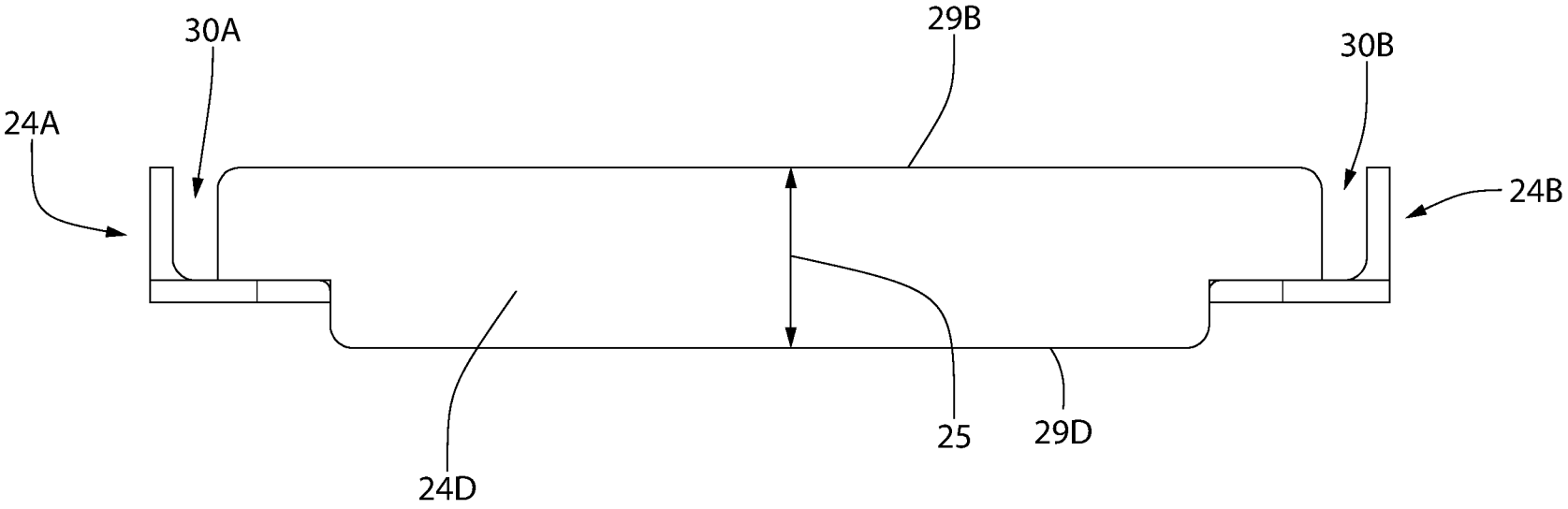
FIG. 8 is an end view of the metal frame of the present invention.
Figure 9:
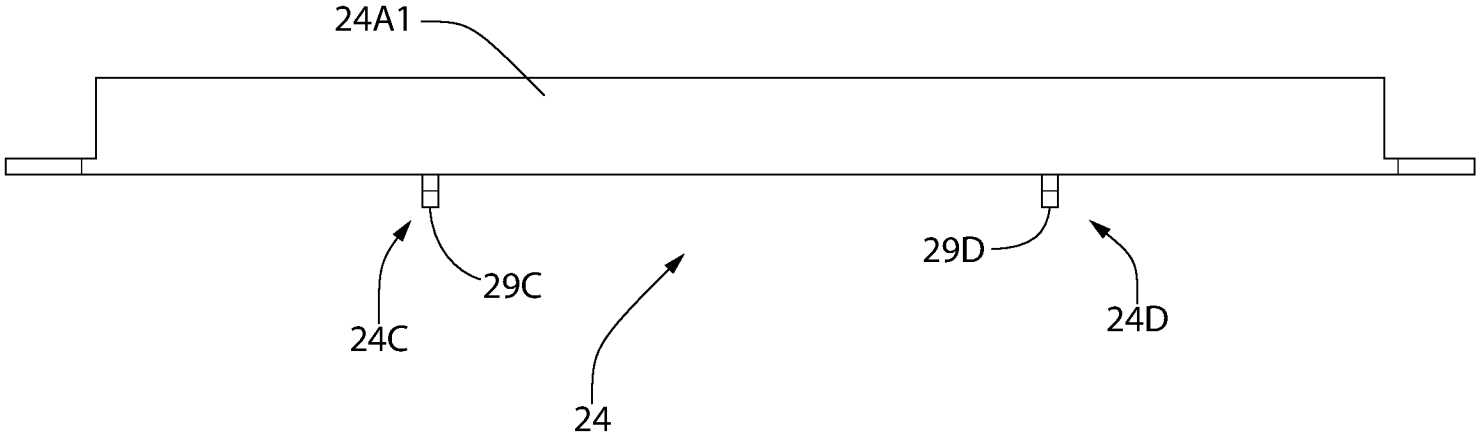
FIG. 9 is a side view of the metal frame of the present invention.

Each rail 24A and 24B comprises a respective sidewall 24A1 and 24B1 as well as a respective base 24A2 and 24B2, as shown in FIG. 6. A gap 30A is provided between one end of the transverse ribs 24A and 24B and the sidewall 24A and a gap 30B is provided between the other end of the transverse ribs 24A and 24B. These gaps 30A and 30B allows the frame 24 to be positioned deep within the plastic lid body 22. FIG. 9 provides a side view of the metal frame 24.

As shown most clearly in FIG. 2, the plastic lid body 22 has opposing long sides 32A (FIG. 2) and 32B (FIG. 5) that are positioned inward of the lid body 22, thereby forming a respective recess 34A (FIG. 2) and 34B (FIG. 5) along each side of the lid body 22. When the metal frame 24 is coupled to the lid body 22 by inserting the transverse ribs 24C and 24D into the corresponding slits 22E and 22F, respectively, the sidewalls 24A1 and 24B1 fit into the corresponding recesses along the long sides of the lid body 22. In addition, the corner projections 22G-22J rest upon respective ends of the bases 24A2 and 24B2. As a result, the elongated rails 24A and 24B form opposing sides of the lid assembly 20 with the transverse ribs 24C and 24D being secured within corresponding slits 22E and 22F in the underside 22B of the lid body 22. Thus, the cross-sectional "L-shape" of each elongated rail 24A/24B, formed by the sidewalls/bases, namely, 24A1/24A2 and 24B1/24B2, respectively, form the sidewalls and their corresponding lower edges of the lid assembly 20.

Figure 13:
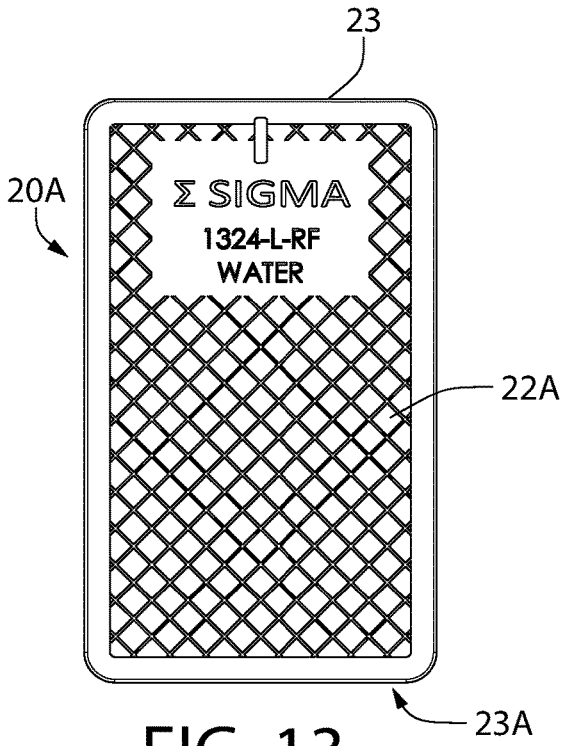
FIG. 13 is a top plan view of another embodiment of the plastic lid/metal frame assembly of the present invention.
Figure 14:
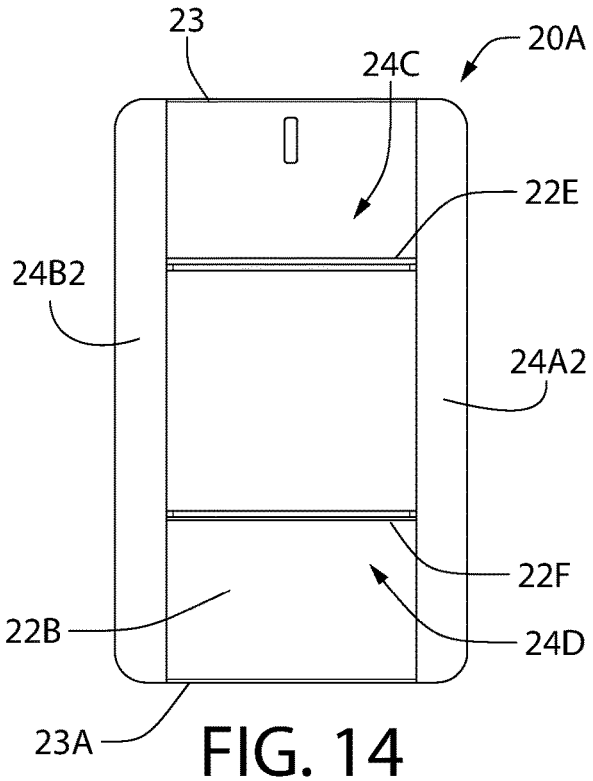
FIG. 14 is a bottom plan view of the embodiment of the plastic lid/metal frame assembly of FIG. 13.

It should be understood that the appearance of the lid assembly 20A in FIGS. 13-14 is slightly different than the lid assembly 20 shown in FIGS. 1-4 since there is no door 26 or a countersunk portion 28 having an aperture 28A; however, in all other aspects, lid assembly 20A is identical to lid assembly 20.

Figure 10:
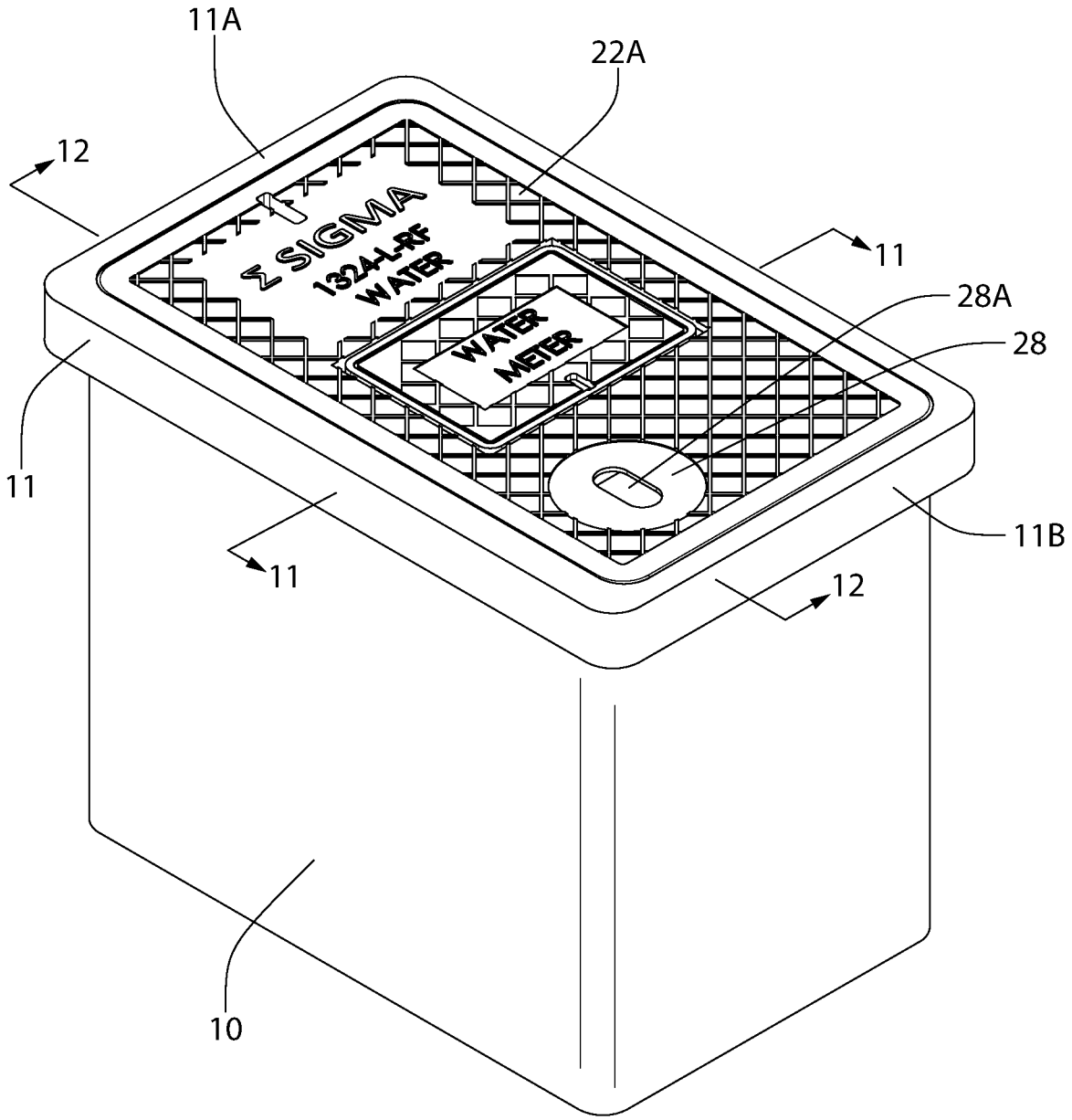
FIG. 10 is an isometric view of the plastic lid/metal frame assembly of the present invention positioned in the lid seat of an in-ground box.
Figure 11:
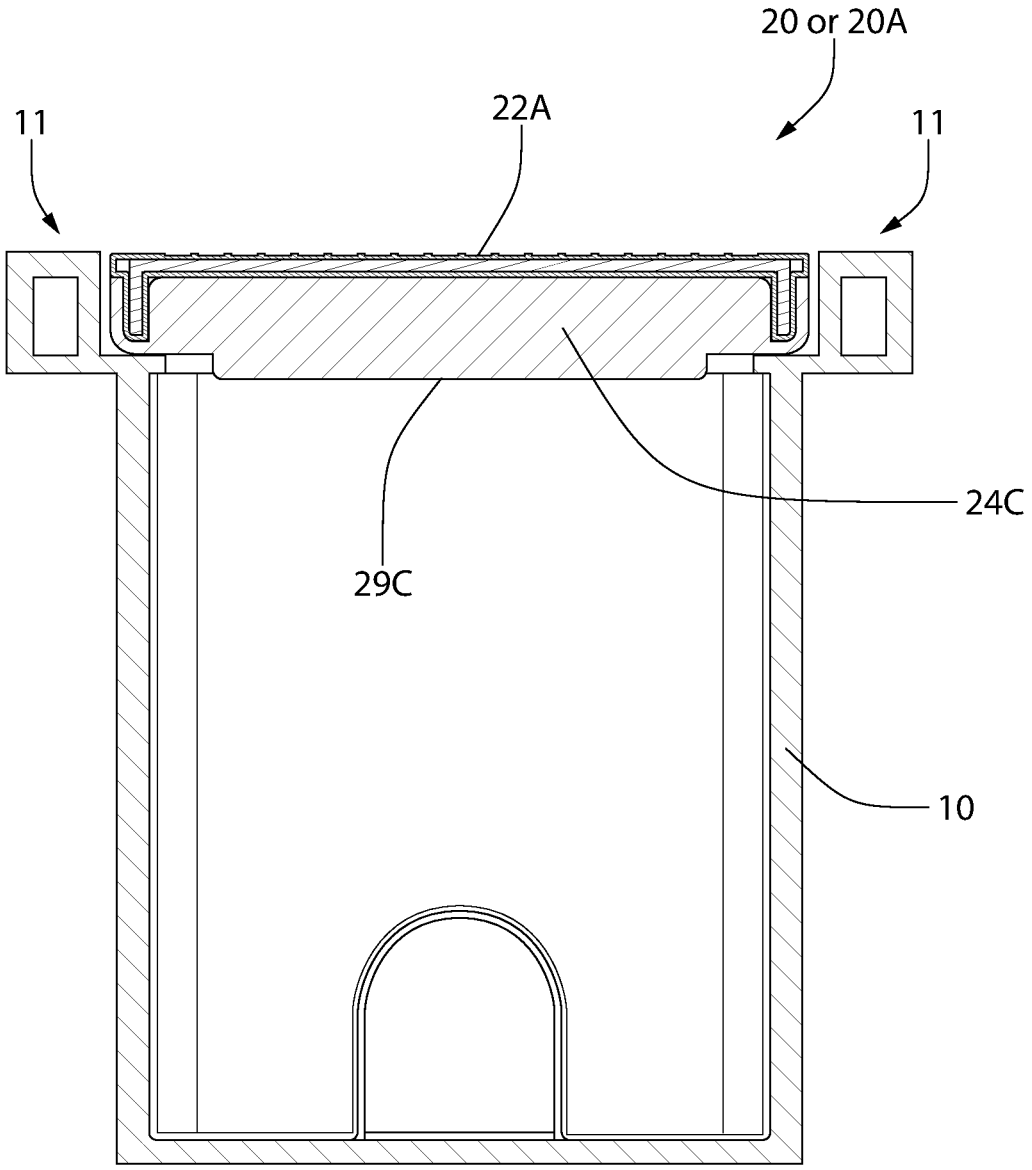
FIG. 11 is a cross-sectional view of the plastic lid/metal frame assembly positioned in the lid seat of the in-ground meter box taken along line 11-11 of FIG. 10.
Figure 12:
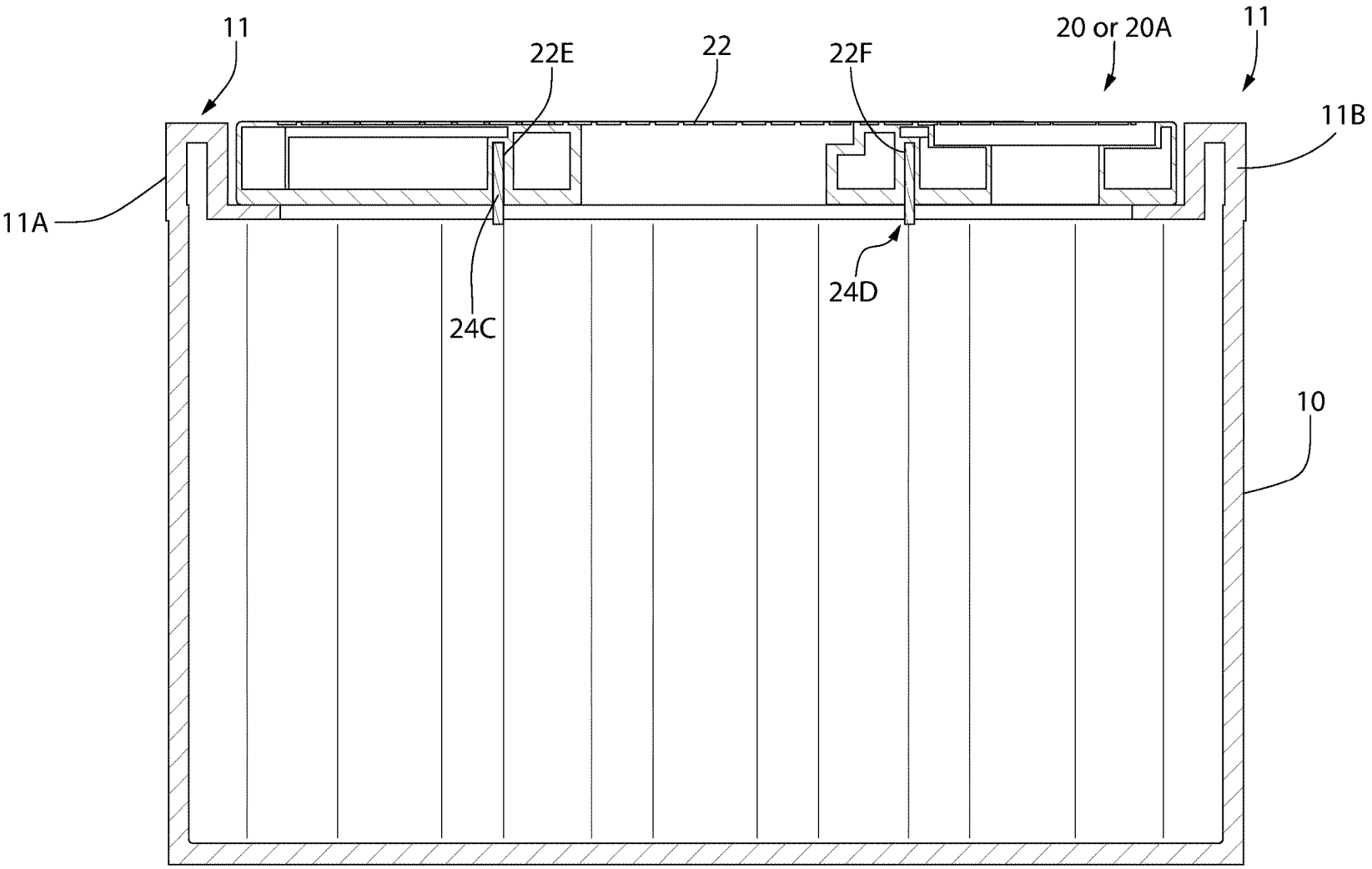
FIG. 12 is a cross-sectional side view of the plastic lid/metal frame assembly positioned in the lid seat of the in-ground meter box taken along line 12-12 of FIG. 10.

As shown most clearly in FIGS. 10-12, the in-ground box 10 comprises a lid seat 11into which the lid assembly 20 (or 20A) is positioned and rests thereon. A front end 11A and a rear end 11B of the lid seat 11 are also shown in those figures. When the lid assembly 20 (or 20A) is positioned in the lid seat 11, it forms a tight fit within the seat 11 to cover the in-ground meter box 10.

One problem with meter box lids for in-ground meter boxes is that they are prone to being inadvertently covered by something (e.g., items, vehicles, or anything this may be sitting on top of the lid assembly 20), thereby obscuring their location. When the service technician arrives to service any part of the meter equipment, he/she may find it difficult to locate the meter box 10 due to the presence of debris on the lid assembly 20. To facilitate the locating of the meter box 10, the metal frame 24 also provides another advantage. Not only does the presence metal frame 24 strengthen the lid assembly 20, but its ferromagnetic characteristic allows a metal detector to detect them, and thereby identifying the presence of the meter box 10 that is obscured.

Furthermore, the lid assembly 20/20A is tier-rated to comply with the municipality test requirements. In-house load testing of the lid assembly 20/20A resulted in the lid assembly 20/20A holding 22,500 lbs. FIGS. 15-16 show a pick-up truck PT (rolling load of 1500 lbs) and a flatbed truck FT (full rolling load of 11,000 lbs), respectively, riding over the plastic lid/metal frame assembly 20/20A of the present invention when installed on an in-ground meter box 10 with no damage to the present invention.

The lid assembly 20/20A can be configured for a wide variety of in-ground meter boxes 10, e.g., sizes 1015, 1118, 1324, 1527, 1730, 1416 and 1618.

While the invention has been described in detail and with reference to specific examples thereof, it will be apparent to one skilled in the art that various changes and modifications can be made therein without departing from the spirit and scope thereof.

What is claimed is:

1. A lid assembly configured for being positioned on top of an in-ground meter box to form a cover of the in-ground meter box, said lid assembly comprising:

a plastic member forming the lid, said lid having a pair of long sides and wherein each long side has a recess therein and wherein a bottom side of said lid comprises a pair of slits, transverse to said long sides;

a metal frame having a pair of elongated rails coupled together by a pair of transverse ribs; and wherein said metal frame is attached to said lid such that a portion of each of said transverse ribs is positioned within a corresponding slit and wherein each of said elongated rails is positioned within a corresponding recess in said lid.

2. The lid assembly of claim 1 wherein said plastic member is formed of linear low-density polyethylene (LLDPE).

3. The lid assembly of claim 1 wherein said pair of elongated rails and said pair of transverse ribs comprise steel.

4. The lid assembly of claim 1 wherein each of said transverse ribs comprises a height of 11/2 inches.

5. The lid assembly of claim 1 wherein said lid assembly is non-buoyant should the surrounding environment ever be flooded.

6. The lid assembly of claim 1 wherein said lid assembly is detectable by a metal detector.

7. The lid assembly of claim 1 further comprising a passageway formed in a central region of said plastic lid from a top side to a bottom side of said lid and wherein a door is removably positioned within said passageway, said door being removable to permit access through said lid without having to raise said lid assembly when said lid assembly is positioned on top of the meter box.

8. The lid assembly of claim 1 further comprising a passageway from a top side to a bottom side of said body, said passageway on said top side comprising a countersunk portion which are configured to receive a wireless transponder therein.

9. The lid assembly of claim 1 wherein said lid assembly supports a weight of up to 22,500 pounds.

10. A method of forming a lid assembly configured for covering an in-ground meter box to form a cover to the in-ground meter box, said method comprising:

forming a plastic lid having having a pair of long sides each of which comprises a recess therein and with a pair of narrow slits in a bottom side of said lid and running transverse to said long sides;

forming a metal frame having a pair of elongated rails coupled together by a pair of transverse ribs, said transverse ribs being spaced apart from each other to align with said pair of narrow slits; and inserting an upper edge of said pair of transverse ribs into respective slits to attach said metal frame to said plastic lid and wherein said pair of elongated rails are seated within respective recesses in said plastic lid.

11. The method of claim 10 wherein an adhesive is applied within said pair of narrow slits before said step of inserting.

12. The method of claim 10 wherein said plastic lid is formed of linear low-density polyethylene (LLDPE).

13. The method of claim 10 wherein said pair of elongated rails and said pair of transverse ribs comprises steel.

14. The method of claim 10 wherein each of said transverse ribs comprises a height of 11/2 inches.

15. The method of claim 10 wherein said lid assembly is detectable by a metal detector.

16. The method of claim 10 further comprising the step of forming a passageway in a central region of said plastic lid from a top side to a bottom side of said lid and wherein a door is removably positioned within said passageway, said door being removable to permit access through said lid without having to raise the lid when said lid assembly is positioned on top of the in-ground meter box.

17. The method of claim 10 further comprising the step of forming a passageway from a top side to a bottom side of said lids, said passageway on said top side comprising a countersunk portion which are configured to receive a wireless transponder therein.

18. The method of claim 10 wherein said lid assembly supports a weight of up to 22,500 pounds.

* * * * *